US012516404B2

(12) United States Patent
Lee et al.

(10) Patent No.: US 12,516,404 B2
(45) Date of Patent: Jan. 6, 2026

(54) ZINC-BASED PLATED STEEL SHEET HAVING EXCELLENT ROOM TEMPERATURE AGING RESISTANCE AND BAKE HARDENABILITY, AND METHOD FOR PRODUCING SAME

(71) Applicant: POSCO, Pohang-si (KR)

(72) Inventors: Je-Woong Lee, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 212 days.

(21) Appl. No.: 16/956,241

(22) PCT Filed: Nov. 23, 2018

(86) PCT No.: PCT/KR2018/014520
§ 371 (c)(1),
(2) Date: Jun. 19, 2020

(87) PCT Pub. No.: WO2019/124781
PCT Pub. Date: Jun. 27, 2019

(65) Prior Publication Data

US 2020/0332398 A1 Oct. 22, 2020

(30) Foreign Application Priority Data

Dec. 24, 2017 (KR) ..... 10-2017-0178923

(51) Int. Cl.

| | |
|---|---|
| ***C22C 38/04*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C23C 2/02*** | (2006.01) |
| ***C23C 2/06*** | (2006.01) |

(52) U.S. Cl.
CPC ..... *C22C 38/04* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/06* (2013.01); *C23C 2/02* (2013.01); *C23C 2/0224* (2022.08); *C23C 2/06* (2013.01); *C21D 2211/005* (2013.01)

(58) Field of Classification Search
CPC ... B32B 15/013; C21D 2211/005; C21D 9/46; C22C 38/001; C22C 38/004; C22C 38/02; C22C 38/04; C23C 2/02; C23C 2/06
USPC ..... 420/127
See application file for complete search history.

(56) References Cited

U.S. PATENT DOCUMENTS

| | | | | |
|---|---|---|---|---|
| 5,690,755 | A * | 11/1997 | Yoshinaga | C21D 8/0436 148/333 |
| 6,217,675 | B1 * | 4/2001 | Taniguchi | C22C 38/002 148/330 |
| 6,361,624 | B1 * | 3/2002 | Altemus | C21D 8/0473 420/128 |
| 2003/0129444 | A1 | 7/2003 | Matsuoka et al. | |
| 2013/0248060 | A1 | 9/2013 | Maruyama et al. | |
| 2018/0202020 | A1 | 7/2018 | Han et al. | |

FOREIGN PATENT DOCUMENTS

| | | | |
|---|---|---|---|
| CN | 1386140 | | 12/2002 |
| CN | 103221567 | | 7/2013 |
| CN | 103975082 | | 8/2014 |
| IN | 201727036153 | | 12/2017 |
| JP | S61056245 | | 3/1986 |
| JP | H0426747 | A | 1/1992 |
| JP | 07268544 | | 10/1995 |
| JP | 07116581 | | 12/1995 |
| JP | 2001200337 | | 7/2001 |
| JP | 2002012920 | | 1/2002 |
| JP | 2002012920 | A * | 1/2002 |
| JP | 2004292891 | | 10/2004 |
| JP | 2006016630 | | 1/2006 |
| JP | 2007077511 | | 3/2007 |
| JP | 2007270167 | | 10/2007 |
| JP | 2008110387 | | 5/2008 |

(Continued)

OTHER PUBLICATIONS

NPL: on-line translation of JP 2007077511 A, Mar. 2007 (Year: 2007).*
NPL: on-line English abstract translation of JP-2002012920-A, Jan. 2002 (Year: 2002).*
Japanese Office Action—Japanese Application No. 2020-534945 issued on Sep. 28, 2021, citing JP H07-116581, KR 10-2011-0041112, JP 2007-077511, JP 2007-270167, JP S61-056245, WO 2016/170794, and JP 2013-139624.
International Search Report—PCT/KR2018/014520 dated Feb. 27, 2019.

(Continued)

*Primary Examiner* — Jie Yang
(74) *Attorney, Agent, or Firm* — CANTOR COLBURN LLP

(57) ABSTRACT

A zinc-based plated steel sheet having excellent room temperature aging resistance and bake hardenability includes a base steel sheet and a zinc-based plating layer formed on the surface of the base steel sheet, wherein the base steel sheet contains, in wt %, no more than 0.005% (excluding 0%) of C, 0.1-1.0% of Mn, no more than 0.3% (excluding 0%) of Si, 0.01-0.08% of P, no more than 0.01% of S, no more than 0.01% of N, 0.01-0.06% of sol.Al, 0.002-0.02% of Nb, and 0.001-0.004% (excluding 0.001%) of B, with the remainder comprising Fe and inevitable impurities, and CS in formula 1 below may satisfy the range of 0.0002-0.002%. In formula 1, [C] and [Nb] represent the contents (wt %) of C and Nb, respectively, in the base steel sheet.

$$CS=[C]-(12/93)*[Nb] \quad \text{[Formula 1]}$$

12 Claims, No Drawings

(56) References Cited

FOREIGN PATENT DOCUMENTS

| | | |
|---|---|---|
| JP | 2013139624 | 7/2013 |
| KR | 20000038789 | 7/2000 |
| KR | 20020073564 | 9/2002 |
| KR | 20090131254 | 12/2009 |
| KR | 20110041112 | 4/2011 |
| KR | 20150137646 | 12/2015 |
| KR | 20170012865 | 2/2017 |
| WO | 2016170794 | 10/2016 |

OTHER PUBLICATIONS

Chinese Office Action—Chinese Application No. 201880082868.7 issued on Mar. 23, 2021, citing CN 103975082, CN 1386140, CN 103221567, and JP 2001-200337.

Mexican Office Action—Mexican Application No. MX/a/2020/006643 issued on Sep. 30, 2024, citing JP H04-26747A, JP H07-268544A, JP 2001-200337A, and JP 2002-012920A.

* cited by examiner

ZINC-BASED PLATED STEEL SHEET HAVING EXCELLENT ROOM TEMPERATURE AGING RESISTANCE AND BAKE HARDENABILITY, AND METHOD FOR PRODUCING SAME

TECHNICAL FIELD

The present disclosure relates to a zinc-based plated steel sheet and a method for manufacturing the same, and more particularly, to a zinc-based plated steel sheet having excellent room-temperature aging resistance and bake hardenability, appropriately applied to external panels of automobiles, and a method for manufacturing the same.

BACKGROUND ART

A material for external panels of automobiles is required to have a fixed level of hardenability and aging resistance. Bake hardening refers to a phenomenon in which solid-solution carbon and nitrogen, activated during paint baking, are fixed to a dislocation occurring during working of a steel sheet to increase yield strength of the steel sheet. Steel having excellent bake hardenability has significantly ideal characteristics as a material for external panels of automobiles because forming of a steel sheet is easily performed before paint annealing and dent resistance of an end product is improved. However, when bake hardenability of the steel sheet is increased, aging resistance of the steel sheet tends to be deteriorated. Therefore, aging occurs with the lapse of a predetermined time even when the hardenability of the steel sheet is ensured, which results in an increased possibility that defects will occur during working of components. Accordingly, there is demand for development of a material, in which at least a certain level of anti-aging characteristics are secured while securing at least a certain level of bake hardenability, as a material for external panes of automobiles.

Patent Document 1 proposes a method for producing a steel material having excellent formability and bake hardenability. However, a planar anisotropy index (Δr) is significantly high due to insufficient optimization of operating conditions such as control of hot-rolled precipitates, an annealing temperature, and the like. Accordingly, wrinkle defects frequently occur on a vehicular knob during working of an external panel of an automobile.

Patent Document 2 proposes a steel sheet having improved ductility and elongation flange properties. The steel sheet has a composite structure including ferrite as a main phase, retained austenite as a secondary phase, and bainite and martensite as a low-temperature transformation phase. However, due to addition of large amounts of silicon (Si) and aluminum (Al) to secure a retained austenite phase, it is difficult to secure plating quality and also difficult to secure surface quality during steelmaking and continuous casting. In addition, since transformation induced plasticity causes an initial YS value to be increased, a yield ratio is high.

Patent Document 3 proposes a high-tensile hot-dip galvanized steel sheet including soft ferrite and hard martensite as a microstructure and having improved elongation and excellent workability with an improved r-value (anisotropy coefficient). However, addition of a large amount of silicon (Si) makes it difficult to secure excellent plating quality. In addition, addition of large amounts of titanium (Ti) and molybdenum (Mo) causes manufacturing costs to be significantly increased.

(Patent Document 1) Korean Patent Publication No. 10-2000-0038789 (published on May 7, 2000)

(Patent Document 2) Japanese Laid-Open Patent Publication No. 2004-292891 (published on Oct. 21, 2004)

(Patent Document 3) Korean Patent Publication No. 10-2002-0073564 (published on Sep. 27, 2002)

DISCLOSURE

Technical Problem

An aspect of the present disclosure is to provide a zinc-based plated steel sheet having excellent room-temperature aging resistance and bake hardenability and a method for manufacturing the same.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Technical Solution

According to an aspect of the present disclosure, a zinc-based plated steel sheet having excellent room-temperature aging resistance and bake hardenability includes a base steel sheet and a zinc-based plated layer formed on a surface of the base steel sheet. The base steel sheet includes, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities, and $C_S$ of Relational Expression 1 below may satisfy a range of 0.0002% to 0.002%, $$C_S=[C]-(12/93)*[Nb] \quad \text{Relational Expression 1:}$$

where [C] and [Nb] of Relational Expression 1 refer to contents (wt %) of C and Nb of the base steel sheet, respectively.

The base steel sheet may be a cold-rolled steel sheet.

A microstructure of the base steel sheet may be a ferrite single-phase structure, and grains having an average diameter of 8 μm or less may account for 70% or more in grains of the ferrite single-phase structure, as a ratio of an area to a cross section of the steel sheet.

A lower-bake hardening (L-BH) value of the plated steel sheet may be 30 MPa or more, and an aging index (AI) of the plated steel sheet may be 0.2% or less.

Yield strength of the plated steel sheet may be 210 MPa or more, and an elongation of the plated steel sheet may be 35% or more.

According to an aspect of the present disclosure, a zinc-based plated steel sheet having excellent room-temperature aging resistance and bake hardenability includes abase steel sheet and a zinc-based plated layer formed on a surface of the base steel sheet. The base steel sheet includes, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities, and $R_B$ of Relational Expression 2 below may be 1.2 or more, $$R_B = R(\mathrm{BH})/R(\mathrm{AI}), \quad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

The base steel sheet may be a cold-rolled steel sheet.

A microstructure of the base steel sheet may be a ferrite single-phase structure, and grains having an average diameter of 8 μm or less may account for 70% or more in grains of the ferrite single-phase structure, as a ratio of an area to a cross section of the steel sheet.

A lower-bake hardening (L-BH) value of the plated steel sheet may be 30 MPa or more, and an aging index (AI) of the plated steel sheet may be 0.2% or less.

Yield strength of the plated steel sheet may be 210 MPa or more, and an elongation of the plated steel sheet may be 35% or more.

According to an aspect of the present disclosure, a zinc-based plated steel sheet having excellent room-temperature aging resistance and bake hardenability includes abase steel sheet and a zinc-based plated layer formed on a surface of the base steel sheet. The base steel sheet includes, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities, $C_S$ of Relational Expression 1 below may satisfy a range of 0.0002% to 0.002%, and $R_B$ of Relational Expression 2 below may be 1.2 or more, $$C_S = [C] - (12/93) * [Nb] \quad \text{Relational Expression 1:}$$

where [C] and [Nb] of Relational Expression 1 refer to contents (wt %) of C and Nb of the base steel sheet, respectively, and $$R_B = R(\mathrm{BH})/R(\mathrm{AI}), \quad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

The base steel sheet may be a cold-rolled steel sheet.

A microstructure of the base steel sheet may be a ferrite single-phase structure, and grains having an average diameter of 8 μm or less may account for 70% or more in grains of the ferrite single-phase structure, as a ratio of an area to a cross section of the steel sheet.

A lower-bake hardening (L-BH) value of the plated steel sheet may be 30 MPa or more, and an aging index (AI) of the plated steel sheet may be 0.2% or less.

Yield strength of the plated steel sheet may be 210 MPa or more, and an elongation of the plated steel sheet may be 35% or more.

An aspect of the present disclosure, a zinc-based plated steel sheet having excellent room-temperature aging resistance and bake hardenability is manufactured by reheating a slab to a temperature within a range of 1160° C. to 1250° C., the slab comprising, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities, hot rolling the reheated slab to a temperature within a range of 850° C. to 1150° C. to provide a hot-rolled steel sheet, cooling the hot-rolled steel sheet at an average cooling rate of 10° C./sec to 70° C./sec and coiling the cooled hot-rolled steel sheet to a temperature within a range of 500° C. to 750° C., cold rolling the coiled hot-rolled steel sheet at a reduction ratio of 70% to 90% to provide a cold-rolled steel sheet, heating the cold-rolled steel sheet in a furnace atmosphere with a hydrogen concentration of 3% to 30% to a temperature within a range of 750° C. to 860° C. to be continuously annealed, cooling the continuously annealed cold-rolled steel sheet, and providing the cold-rolled steel sheet as a base steel sheet and dipping the cold-rolled steel sheet into a hot-dip zinc-based plating bath to manufacture a zinc-based plated steel sheet.

In this case, the cold rolling may be performed by sequential reduction using a plurality of rolling rolls and a reduction ratio of an initial rolling roll, among the plurality of rolling rolls, may be 20% to 40%. In the base steel, $C_S$ of Relational Expression 1 below may satisfy a range of 0.0002% to 0.002%, and $R_B$ of Relational Expression 2 below may be 1.2 or more, $$C_S = [C] - (12/93) * [Nb] \quad \text{Relational Expression 1:}$$

where [C] and [Nb] of Relational Expression 1 refer to contents (wt %) of C and Nb of the base steel sheet, respectively, and $$R_B = R(\mathrm{BH})/R(\mathrm{AI}), \quad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

The annealed cold-rolled steel sheet may be primarily cooled to a temperature within a range of 630° C. to 670° C. at an average cooling rate of 2° C./sec to 10° C./sec, and the primarily cooled cold-rolled steel sheet may be secondarily cooled to a temperature within a range of 440° C. to 480° C. at an average cooling rate of 3° C./sec to 20° C./sec.

The cold-rolled steel sheet may be dipped in a hot-dip zinc-based plating bath of 440° C. to 480° C.

The zinc-based plated steel sheet may be temper-rolled at a reduction ratio of 0.3% to 1.6%.

Advantageous Effects

According to an aspect of the present disclosure, yield strength is 210 MPa or less, an aging index (AI) evaluating room-temperature aging resistance is 0.2 or less, and a lower-bake hardening (L-BH) value is 30 MPa or more. Therefore, a zinc-based plated steel sheet having excellent room-temperature aging resistance and bake hardenability and a method for the same may be provided.

BEST MODE FOR INVENTION

The present disclosure relates to a zinc-based plated steel sheet having excellent room-temperature aging resistance and bake hardenability and a method for manufacturing the same. Hereinafter, example embodiments of the present disclosure will be described below. Example embodiments of the present disclosure maybe modified in various forms, and the scope of the present disclosure should not be construed as being limited to the embodiments described below. These embodiments are provided to complete the present disclosure and to allow those skilled in the art to understand the scope of the disclosure.

A zinc-based plated steel sheet having excellent room-temperature aging resistance and bake hardenability according to an aspect of the present disclosure include a base steel sheet and a zinc-based plated layer formed on a surface of the base steel sheet.

The base steel sheet includes, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities.

The base steel sheet of the present disclosure may be a cold-rolled steel sheet, but should not be construed as necessarily limited to a cold-rolled steel sheet. In addition, the zinc-based plated layer of the present disclosure may include a hot-dip zinc-based plated layer and a hot-dip zinc-based alloy plated layer, but should not be construed as necessarily limited to a hot-dip zinc-based plated layer and a hot-dip zinc-based alloy plated layer.

Hereinafter, a composition of steel of the present disclosure will be described in detail. Hereinafter, unless otherwise specified, the content of each component means weight percentage (wt %).

C: 0.005% or Less (Excluding 0%)

Carbon (C) is an interstitial solid element. Carbon (C) solid-solubilized in steel enters a locking interaction with a dislocation, formed by temper rolling, to exhibit bake hardenability. Therefore, the higher the content of carbon (C), the more the hardenability is improved. In the present disclosure, since carbon (C) is necessarily added to achieve such an effect, 0% may be excluded from a lower limit of the content of carbon (C). However, when an excess amount of solid carbon (C) is present in steel, orange peel, a surface defect, may occur during component forming to cause poor aging. Therefore, in the present disclosure, an upper limit of the content of carbon (C) maybe limited to 0.005%. In the present disclosure, a lower limit of the content of carbon (C) may not be necessarily limited. However, the lower limit of the content of carbon (C) may be limited to, in detail, 0.001% in consideration of the range of carbon (C) unavoidably included in a steelmaking process.

Mn: 0.1 to 1.0%

Manganese (Mn) is a solid-solution strengthening element, and not only contributes to an increase in strength of the steel but also serves to precipitate sulfur (S) in the steel as MnS. In the present disclosure, a lower limit of the content of manganese (Mn) may be limited to 0.1% to achieve an effect of improving drawability by precipitation of MnS. However, when an excessive amount of manganese (Mn) is added, the drawability may be lowered by excessive solid solution of manganese (Mn), independently of an increase in yield strength. For this reason, in the present disclosure, an upper limit of the content of manganese (Mn) maybe limited to 1.0%. Therefore, in the present disclosure, the content of manganese (Mn) may be in the range of 0.1% to 1.0%. The content of manganese (Mn) may be in the range of, in further detail, 0.2% to 0.9%.

Si: 0.3% or Less (Excluding 0%)

Silicon (Si) is an element contributing to an increase in strength of steel by solid solution strengthening. However, in the present disclosure, silicon (Si) is not an element intentionally added to secure strength. This is because even when silicon (Si) is not added, there is no significant difficulty in securing target physical properties. However, 0% may be excluded from the content of silicon (Si) in consideration of a range of the content of silicon (Si) inevitably included in a steelmaking process. On the other hand, when silicon (Si) is excessively added, characteristics of a plated surface maybe deteriorated. Therefore, in the present disclosure, a lower limit of the content of silicon (Si) may be limited to 0.3%. The lower limit of the content of silicon (Si) may be, in further detail, 0.2%.

P: 0.01 to 0.08%

Phosphorus (P) has an excellent solid solution effective and is most effective in securing strength of steel without significantly reducing drawability. In particular, phosphorus (P) is likely to be segregated in grain boundaries to inhibit grain growth during annealing, and thus, contributes to grain refinement to help in improvement of room-temperature aging resistance. In the present disclosure, a lower limit of the content of phosphorus (P) maybe limited to 0.01% to achieve an effect of improving the strength and the room-temperature aging resistance. On the other hand, when phosphorus (P) is added excessively, there is possibility that an excess amount of solid solution P is segregated in the grain boundary to lose an opportunity for grain boundary segregation of Boron (B) and Carbon (C) required in the present disclosure. Accordingly, there is a possibility that target room-temperature aging resistance may not be secured. In addition, when phosphorus (P) is excessively added, secondary work brittleness may occur as the grain boundary segregation of phosphorus (P) is increased. For this reason, in the present disclosure, an upper limit of the content of phosphorus (P) may be limited to 0.08%. Therefore, in the present disclosure, the content of phosphorus (P) may be in the range of 0.01% to 0.08%. The content of phosphorus (P) may be in the range of, in further detail, 0.015% to 0.075%.

S: 0.01% or Less

Sulfur (S) is an impurity unavoidably included in the steelmaking process, and the content of sulfur (S) is preferably controlled to be as low as possible. In particular, since sulfur (S) in steel is an element increasing possibility that red shortness occurs, in the present disclosure, an upper limit of the content of sulfur (S) may be limited to 0.01%. The upper limit of the content of sulfur (S) maybe, in further detail, 0.008%.

N: 0.01% or Less

Nitrogen (N) is also an impurity unavoidably included in the steelmaking process. The content of nitrogen (N) is preferably controlled to be as low as possible. However, since refining costs may be significantly increased to control the content of nitrogen (N) to a low level, in the present disclosure, an upper limit of the content of nitrogen (N) may be limited to 0.01%, a range in which an operation may be performed. The upper limit of the content of nitrogen (N) may be, in further detail, 0.008%.

sol.Al: 0.01 to 0.06%

Soluble aluminum (sol.Al) is an element added for grain refinement and deoxidation. In the present disclosure, a lower limit of soluble aluminum (sol.Al) may be limited to 0.01% to produce Al-killed steel. However, when soluble aluminum (sol.Al) is excessively added, it is advantageous to increase the strength of the steel due to a grain refinement effect. Meanwhile, inclusions are excessively formed during a steelmaking continuous casting operation to increase possibility that surface defects of a plated steel sheet occur and to result in a rapid increase in manufacturing costs. For this reason, in the present disclosure, an upper limit of the content of soluble aluminum (sol.Al) may be limited to 0.06%. Therefore, in the present disclosure, the content of soluble aluminum (sol.Al) may be in the range of 0.01% to 0.06%. The content of soluble aluminum (sol.Al) may be in the range of, in further detail, 0.02% to 0.055%.

Nb: 0.002 to 0.02%

Niobium (Nb) is a major element affecting bake hardenability and aging resistance of steel in the present disclosure. As the content of carbon (C) solid-solubilized in the steel is increased, the aging resistance is improved while the bake hardenability tends to be decreased. However, since niobium (Nb) binds to carbon (C) in the steel during hot rolling to form NbC precipitates, the content of solid-solubilized carbon (C) may be controlled. Accordingly, in the present disclosure, the content of niobium (Nb) is adjusted to an appropriate level to control the content of carbon (C) solid-solubilized in the steel to an appropriate level. As a result, the present disclosure is aimed at securing bake hardenability and aging resistance of an appropriate level or higher.

When the content of niobium (Nb) is less than 0. 002%, the content of carbon (C) precipitated as NbC is significantly low. Therefore, most of the carbon (C) in the steel remains in the form of solid carbon (C) to prevent room-temperature aging resistance from being sufficiently secured. In addition, when the content of niobium (Nb) is greater than 0.02%, most of the carbon (C) in the steel is precipitated as NbC to cause an absolutely low content of carbon (C) solid-solubilized in the steel. Accordingly, desired bake hardenability may not be secured. Therefore, in the present disclosure, the content of niobium (Nb) maybe in the range of 0.002% to 0.02%. The content of niobium (Nb) may be in the range of, in detail, 0.003 to 0.02%. The content of niobium (Nb) may be in the range of, in further detail, 0.004 to 0.015%.

B: 0.001 to 0.004% (Excluding 0.001%)

Boron (B) is an important element affecting bake hardenability and aging resistance of a steel material in the present disclosure. Boron (B) is known as an element added to prevent secondary working embrittlement caused by grain boundary embrittlement in ultra-low carbon steel including a large amount of phosphorus (P). Since boron (B) is an element having a higher grain boundary segregation tendency than other elements, boron (B) may inhibit grain boundary segregation of phosphorus (P) by addition of boron (B) to prevent the secondary working embrittlement. However, the present inventors conducted a great number of experiments, associated with room-temperature aging resistance and bake hardenability, using grain boundary segregation characteristics of boron (B) and reached the content of boron (B) of the present disclosure, based on the results of the experiments.

Aging property and bake hardenability are similar in mechanism, and are mechanisms caused by a locking interaction between dislocation and solid-solution elements (C, B, and the like). For example, as the locking interaction between the solid-solution elements and the dislocation is increased, both the aging property and the bake hardenability are increased. Since bake hardening steel used as a material for external panels of automobiles is advantageous as aging hardenability is excellent and aging property is low, that is, aging hardenability and aging resistance are excellent, it is important to secure at least a certain level of aging hardenability and aging resistance by controlling an appropriate level of alloying components.

When boron (B) is segregated in grain boundaries during annealing of steel to be stabilized at room temperature, most of the boron (B) remains in the grain boundaries at a low aging evaluation temperature (about 100° C.) and diffusion of boron (B) into the grain boundaries is inhibited. Accordingly, a locking interaction between dislocation and boron (B) is inhibited to effectively secure room-temperature aging resistance. On the other hand, boron (B) segregated in the grain boundaries may be easily diffused into grains to be solid-solubilized at a relatively high baking temperature (about 170° C.), and the boron (B) solid-solubilized in the grains and the dislocation may interact with each other to secure bake hardenability. That is, the present disclosure is aimed at securing at least a certain level of aging resistance and aging hardenability using behavior characteristics of boron (B) exhibited to be different at an aging evaluation temperature (about 100° C.) and a baking temperature (170° C.)

Since the present disclosure is aimed at securing at least a certain level of the content of boron (B) diffused into grains at a baking temperature to secure bake hardenability, a lower limit of the content of boron (B) may be limited to a range greater than 0.001%. On the other hand, when boron (B) is excessively added, it is excessively segregated in grain boundaries to inevitably lower aging resistance, independently of an increase in bake hardenability. Accordingly, there is high possibility that plating layer separation of a plated steel sheet occurs. Accordingly, an upper limit of the content of boron (B) may be limited to 0.004%. Therefore, in the present disclosure, the content of boron (B) maybe in the range of more than 0.001% to 0.004% or less. The content of boron (B) may be in the range of, in detail, more than 0.001% to 0.003% or less. The content of boron (B) maybe in the range of, in further detail, more than 0.0013% to 0.0025% or less.

In the present disclosure, the zinc-based steel sheet may include a balance of iron (Fe) and unavoidable impurities, other than the above-mentioned steel composition. The unavoidable impurities may be unintentionally mixed in a conventional steelmaking process and may not be entirely excluded, which will be easily understood by a person of an ordinary skill in the steel manufacturing industry. Moreover, addition of another composition, other than the above-mentioned steel composition, is not entirely excluded in the present disclosure.

In the base steel sheet included in the zinc-based plated steel sheet having excellent room-temperature aging resistance and bake hardenability according to an aspect of the present disclosure, the contents of carbon (C) and niobium (Nb) may be limited such that $C_S$ of Relational Expression 1 below satisfies a range of 0.0002% to 0.002%, $$C_S=[C]-(12/93)*[Nb] \quad \text{Relational Expression 2:}$$

where [C] and [Nb] of Relational Expression 1 refer to contents (wt %) of C and Nb of the base steel sheet, respectively.

In additional, in the base steel sheet included in the zinc-based plated steel sheet having excellent room-temperature aging resistance and bake hardenability according to an aspect of the present disclosure, $R_B$ of Relational Expression 2 below is 1.2 or more.

$$R_B = R(\mathrm{BH})/R(\mathrm{AI}) \qquad \text{Relational Expression 2:}$$

R(BH) of Relational Expression 2 denotes a concentration ratio of boron (B) present within 20 nm of a ferrite grain boundary in the base steel sheet in a grain direction during a heat treatment performed on the zinc-based plated steel sheet according to an aspect of the present disclosure at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet according to an aspect of the present disclosure at a temperature of 100° C. for 60 minutes.

Hereinafter, relational expressions of the present disclosure will be described in further detail.

$$C_S = [C] - (12/93) * [Nb] \qquad \text{Relational Expression 1:}$$

In Relational Expression 1, [C] and [Nb] refer to contents (wt %) of C and Nb of the base steel sheet, respectively. In the present disclosure, the contents of carbon (C) and niobium (Nb) of the base steel sheet are controlled such that a value of $C_S$ calculated through Relational Expression 1 satisfies a range of 0.0002% to 0.002%.

In Relational Expression 1, $C_S$ refers to the content of solid carbon (C) remaining in steel after carbon (C) included in a steel material is precipitated as NbC due to addition of niobium (Nb). The present inventors experimentally confirmed that when the value of $C_S$ calculated through Relational Expression 1 was controlled to a certain level, aging resistance and bake hardenability may be secured above a certain level. In addition, the present inventors experimentally confirmed that when the contents of carbon (C) and niobium (Nb) included in the base steel sheet were controlled such that the value of $C_S$ calculated through Relational Expression 1 satisfied 0.0002% to 0.002%, target aging resistance and target bake hardenability of the present disclosure might be ensured.

When the value of $C_S$ is less than 0.0002%, there is almost no carbon (C) solid-solubilized in the base steel sheet. Therefore, a lower-bake hardening (L-BH) value of 30 MPa or more required in the present disclosure may not be secured. When the value of $C_S$ is less than 0.0002%, an excessive amount of boron (B) maybe added to ensure bake hardenability due to solid boron (B), but castability may be deteriorated in a manufacturing process due to the addition of the excessive amount of boron (B). Further, an excessive amount of boron (B) oxide is present between a base steel sheet and a zinc-based plated layer in an end product to cause plating separation. In addition, when the value of $C_S$ is greater than 0.002%, aging resistance may be problematic due to the carbon (C) solid-solubilized in the base steel sheet and aging guarantee of 6 months or more, required by the customer, maybe problematic. Accordingly, Relational Expression 1 of the present disclosure proposes conditions for ensuring optimal aging resistance and bake hardenability, and the contents of carbon (C) and niobium may be controlled such that the value of $C_S$ of Relational Expression 1 satisfies a range of 0.0002% to 0.002%.

$$R_B = R(\mathrm{BH})/R(\mathrm{AI}) \qquad \text{Relational Expression 2:}$$

R(BH) of Relational Expression 2 denotes a concentration ratio of boron (B) present within 20 nm of a ferrite grain boundary in the base steel sheet in a grain direction during a heat treatment performed on the zinc-based plated steel sheet according to an aspect of the present disclosure at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet according to an aspect of the present disclosure at a temperature of 100° C. for 60 minutes. In the base steel sheet of the present disclosure, the value of $R_B$ calculated through Relational Expression 1 may satisfy a range of 1.2 or more.

Relational Expression 2 shows the behavior of temperature-dependent concentrations of boron (B) in a grain boundary and a grain, and means a ratio between a concentration of boron (B) distributed in grains at an aging evaluation temperature (about 100° C.) and a concentration of boron (B) distributed in a grain boundary at a baking temperature (about 170° C.). The present inventors examined grain boundary segregation and diffusion migration of boron (B) through various experimental conditions and confirmed that at least a certain level of bake hardenability and aging resistance could be secured only when the value of $R_B$ of Relational Expression 2 is higher than a certain level. In particular, various factors such as a grain size, the content of boron (B), and the like, in the base steel sheet have an effect on grain boundary segregation and diffusion migration of boron (B). Nonetheless, Relational Expression 2 has a technical significance in that a unified result maybe derived using a ratio between the content of boron (B) segregated in a grain boundary under a low temperature condition during a heat treatment and the content of boron (B) diffusing and migrating into a grain under a high temperature condition during a heat treatment. That is, the present inventors confirmed that when the value of $R_B$ calculated through Relational Expression 2 was less than 1.2, the steel sheet did not satisfy characteristics required in the present disclosure, and when the content of boron (B) was relatively small or grains were coarse, the value of $R_B$ of 1.2 was derived, and thus, at least a certain level of bake hardenability and aging resistance could not be secured.

A lower-bake hardening (L-BH) value of the zinc-based plated steel sheet according to an aspect of the present disclosure may satisfy an aging index (AI) of 0.2% or more while satisfying 30 MPa or more. In addition, since the zinc-based plated steel sheet according to an aspect of the present disclosure has yield strength of 210 MPa or more and an elongation of 35% or more, physical properties appropriate to a sheet material for external panels of automobiles may be secured.

The base steel sheet of the zinc-based plated steel sheet according to an aspect of the present disclosure includes a ferrite single-phase structure as a microstructure, and crystal grains having an average diameter of 8 μm or less account for 70% of grains of the ferrite single-phase structure. For example, when grains of the microstructure are coarse, an effect may be insufficiently implemented in spite of the addition of boron (B). Thus, the base steel sheet of the present disclosure is preferably provided with grains refined to be a certain level or lower.

A method of manufacturing a zinc-base plated steel sheet having excellent room-temperature aging resistance and bake hardenability according to an aspect of the present disclosure includes dipping a base steel sheet having the above-described composition and conditions in a hot-dip zinc-base plating bath, such that plating is performed to manufacture a plated steel sheet.

Hereinafter, the manufacturing method of the present disclosure will be described in detail.

A method for manufacturing a zinc-based plated steel sheet having excellent room-temperature aging resistance and bake hardenability according to an aspect of the present disclosure may include reheating a slab to a temperature within a range of 1160° C. to 1250° C., the slab including, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur (S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities, hot rolling the reheated slab to a temperature within a range of 850° C. to 1150° C. to provide a hot-rolled steel sheet, cooling the hot-rolled steel sheet at an average cooling rate of 10° C./sec to 70° C./sec and coiling the cooled hot-rolled steel sheet to a temperature within a range of 500° C. to 750° C., cold rolling the coiled hot-rolled steel sheet at a reduction ratio of 70% to 90% to provide a cold-rolled steel sheet, heating the cold-rolled steel sheet in a furnace atmosphere with a hydrogen concentration of 3% to 30% to a temperature within a range of 750° C. to 860° C. to be continuously annealed, cooling the continuously annealed cold-rolled steel sheet, and providing the cold-rolled steel sheet as abase steel sheet and dipping the cold-rolled steel sheet into a hot-dip zinc-based plating bath to manufacture a zinc-based plated steel sheet.

In this case, the cold rolling may be performed by sequential reduction using a plurality of rolling rolls and a reduction ratio of an initial rolling roll, among the plurality of rolling rolls, is 20% to 40%. In the base steel, $C_S$ of Relational Expression 1 below may satisfy a range of 0.0002% to 0.002%, and $R_B$ of Relational Expression 2 below may be 1.2 or more, $$C_S=[C]-(12/93)*[Nb] \quad \text{Relational Expression 1:}$$

where [C] and [Nb] of Relational Expression 1 refer to contents (wt %) of C and Nb of the base steel sheet, respectively, and $$R_B=R(BH)/R(AI), \quad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

Reheating Slab

Since the steel composition of the slab of the present disclosure corresponds to the above-described steel composition of the steel sheet, the description of the steel composition of slab steel of the present disclosure is replaced with the above-described description of the steel composition of the steel sheet. A slab having the above-described composition may be reheated to a temperature within a certain temperature range. When the reheating temperature is lower than 1160° C., inclusions and the like of the slab are insufficiently redissolved to provide causes of occurrence of surface defects and material variations after hot rolling. When the reheating temperature is higher than 1250° C., strength of a final steel material may be lowered due to abnormal growth of austenite grains. Therefore, in the present disclosure, the slab reheating temperature range may be 1160° C. to 1250° C.

Hot Rolling

The reheated slab is hot-rolled to provide hot-rolled to provide a hot-rolled steel sheet. When an initiation temperature of the hot rolling is higher than 1150° C., a temperature of the hot-rolled steel sheet may be excessively increased to coarsen grains and to deteriorate surface quality of the hot-rolled steel sheet. When a termination temperature of the hot rolling is lower than 850° C., elongated grains develop due to excessive recrystallization retardation and a high yield ratio is obtained. For this reason, cold rollability and shear workability may be deteriorated. Therefore, in the present disclosure, the hot rolling may be performed to a temperature within the range of 850° C. to 1150° C.

Cooling and Coiling

The hot-rolled steel sheet after hot-rolling may be cooled to a temperature within the range of 500° C. to 750° C. at an average cooling rate of 10° C./sec to 70° C./sec and may be then rolled within a temperature range of 500° C. to 750° C. to provide a hot-rolled coil. When the average cooling rate is less than 10° C./sec, coarse ferrite grains are formed to cause non-uniformity of the microstructure. When the average cooling rate is greater than 70° C./sec, not only a shape of the steel sheet may be deteriorated but also the non-uniformity of the microstructure may be caused to deteriorate the shear workability of the steel sheet. When the coiling temperature of the hot-rolled steel sheet is lower than 500° C., the shape of the steel sheet may be deteriorated due to an excessively low coiling temperature. When the coiling temperature of the hot-rolled steel sheet is higher than 750° C., coarse ferrite grains may be formed and coarse carbide and nitride may be formed. Thus, the material of the steel may be deteriorated.

Cold Rolling

Cold rolling may be performed at a reduction ratio of 70 to 90%. When the reduction ratio of the cold rolling is less than 70%, it may be difficult to secure a target thickness of an end product and it may be difficult to correct a shape of the steel sheet. When the reduction ratio of the cold rolling is greater than 90%, cracking may occur in an edge portion of the steel sheet and an excessive load may be applied to a cold-rolling facility.

The cold rolling of the present disclosure may be performed by a plurality of rolling rolls, sequentially disposed in one direction, and a reduction ratio achieved by an initial rolling roll may be limited to a certain range. When the reduction ratio achieved by the initial rolling roll is less than 20%, there is a limit in controlling the shape of the steel sheet and securing the microstructure. In particular, when the reduction ratio achieved by the initial rolling roll is less than 20%, grains having an average diameter of 8 μm or less may account for 70% or more in grains of the ferrite single-phase structure, as an area ratio to a cross section of the base steel sheet. In addition, when the reduction ratio achieved by the initial rolling roll is greater than 40%, there may be possibility that a facility load is caused. Therefore, in the present disclosure, the reduction ratio achieved by the initial rolling roll maybe limited to 20% to 40%. The reduction ratio achieved by the initial rolling roll may be, in further detail, 25% to 35%.

Continuous Annealing

The cold-rolled steel sheet after cold rolling may be heated to a temperature within a range of 750° C. to 860° C. to be continuously annealed. When the annealing temperature is lower than 750° C., recrystallization may be insufficiently completed to cause a high possibility that a mixed grain structure is formed. When the annealing temperature is higher than 860° C., there may be is a high possibility a facility load is generated in an annealing furnace. Therefore, in the present disclosure, the continuous annealing temperature may be 750° C. to 860° C. and, in further detail, 770° C. to 830° C.

In the present disclosure, the continuous annealing may be performed in a furnace atmosphere with a hydrogen concentration of 3% to 30%. When the hydrogen concentration is less than 3%, there may be a high possibility of surface enrichment of elements having a high affinity with oxygen such as silicon (Si), manganese (Mn), and boron (B) included in the steel, and thus, dent defects and plating defects may occur. When the hydrogen concentration exceeds 30%, an effect of inhibiting the defects resulting from Si, Mn, and B reaches the limit and may cause an excessive increase in manufacturing costs. Therefore, the continuous annealing may be performed in a furnace atmosphere with a hydrogen concentration of 3% to 30%, and the hydrogen concentration may be in the range of, in further detail, 5% to 20%.

Primary Cooling

The cold-rolled steel sheet after the continuous annealing may be primarily cooled to a temperature within the range of 630° C. to 670° C. at an average cooling rate of 2° C./sec to 10° C./sec. When the average cooling rate of the primary cooling is lower than 2° C./sec or when the cooling termination temperature of the primary cooling is higher than 670° C., grains of the ferrite single-phase structure are excessively coarsened to prevent a sufficient grain boundary segregation effect of boron (B) from occurring. For example, since an occupation rate of grains having an average diameter of 8 μm or less is less than 70% as a ratio of an area to a cross section of the base steel sheet, the sufficient grain boundary segregation effect of boron (B) may not occur even when boron (B) is added in a certain amount or more. When the average cooling rate of the primary cooling is greater than 10° C./sec or the cooling termination temperature of the primary cooling is less than 630° C./sec, the grains of the ferrite single-phase structure may be refined to increase the grain boundary segregation effect of boron (B). However, the steel sheet may be distorted and excessive facility temperature imbalance may occur before and after the cooling process, which may cause a facility load.

Secondary Cooling

The cold-rolled steel sheet after the primary cooling may be secondarily cooled to a temperature within a range of 440° C. to 480° C. at an average cooling rate of 3° C./sec to 20° C./sec. In the present disclosure, the cooling rate of the secondary cooling has no significant effect on the physical properties of the steel sheet, but the secondary cooling rate is controlled to a certain range to secure an excellent shape of the steel sheet. When the cooling rate of the secondary cooling is higher than 20° C./sec, problems such as distortion of the steel plate shape may occur. When the cooling rate of the secondary cooling is less than 3° C./sec, it may be economically disadvantageous due to a significant low cooling rate.

Dipping into Plating Bath

The cold-rolled steel sheet after the secondary cooling may be dipped in a hot-dip zinc-based plating bath to form a zinc-based plated layer. The zinc-based plating bath may be a pure zinc (Zn) plating bath, or may be a zinc-based alloy plating bath including silicon (Si), aluminum (Al), magnesium (Mg), and the like. As necessary, an alloying heat treatment maybe performed on the zinc-based plated steel sheet. The alloying heat treatment may be performed at a temperature range of 500° C. to 540° C.

Temper Rolling

As necessary, temper rolling may be performed to provide additional bake hardenability to the zinc-based plated steel sheet. When a reduction ratio of the temper rolling is less than 0.3%, there is a high possibility that a sufficient dislocation required to secure the bake hardenability is not formed. When the reduction ratio is greater than 1.6%, plating surface defects may occur. The reduction ratio of the temper rolling may be limited to 0.3 to 1.6%. The reduction ratio of the temper rolling may be limited to, in further detail, 0.5 to 1.4%.

[Mode for Invention]

Hereinafter, the present disclosure will be described more fully in connection with examples. However, it is understood that the description proposed herein is just a preferable example for the purpose of illustrations only, not intended to limit the scope of the present disclosure. Accordingly, it is considered that the scope of the present disclosure is determined by the appended claims and items rationally derived from the appended claims.

After producing a steel slab having an alloying composition shown in Table 1 below, zinc-based plated steel sheet specimens were prepared through a manufacturing process based on Table 2 below. For the reference, steel types 1, 2, 4, and 5 in Table 1 correspond to alloyed hot-dip galvanized steel sheets (GA steel sheets), and steel types 3 and 6 correspond to hot-dip galvanized steel sheets. Steel types 7 and 8 refer to BH steels using ordinary ultra-low carbon steel.

TABLE 1

| Steel | Alloying Component (wt %) | | | | | | | | |
|---|---|---|---|---|---|---|---|---|---|
| Type | C | Mn | Si | P | S | N | sol.Al | Nb | B |
| 1 | 0.0018 | 0.41 | 0.06 | 0.032 | 0.006 | 0.003 | 0.021 | 0.0078 | 0.0028 |
| 2 | 0.0019 | 0.35 | 0.05 | 0.041 | 0.005 | 0.003 | 0.034 | 0.0081 | 0.0031 |
| 3 | 0.0021 | 0.82 | 0.05 | 0.016 | 0.004 | 0.002 | 0.045 | 0.0065 | 0.0031 |
| 4 | 0.0016 | 0.25 | 0.06 | 0.035 | 0.004 | 0.003 | 0.043 | 0.0052 | 0.0034 |
| 5 | 0.0035 | 0.18 | 0.04 | 0.071 | 0.006 | 0.004 | 0.052 | 0.016 | 0.0013 |
| 6 | 0.0046 | 0.43 | 0.08 | 0.035 | 0.004 | 0.005 | 0.026 | 0.018 | 0.0012 |

TABLE 1-continued

| Steel | Alloying Component (wt %) | | | | | | | | |
|---|---|---|---|---|---|---|---|---|---|
| Type | C | Mn | Si | P | S | N | sol.Al | Nb | B |
| 8 | 0.0019 | 0.61 | 0.06 | 0.062 | 0.004 | 0.002 | 0.035 | 0.0081 | 0.0007 |
| 8 | 0.0021 | 0.58 | 0.07 | 0.064 | 0.007 | 0.004 | 0.045 | 0 | 0 |

TABLE 2

| | | Hot Rolling | | | | Cold Rolling | | Continuous Annealing | | | | |
|---|---|---|---|---|---|---|---|---|---|---|---|---|
| Steel Type | Class-ification | Reheating Temp-erature (° C.) | Finish Rolling Temp-erature (° C.) | Coiling Temp-erature (° C.) | Cooling Rate Before Coiling (° C./sec) | Cold Re-duction Ratio (%) | Initial Cold-Rolled Stand Reduction Ratio (%) | Annealing Temp-erature (° C.) | Concen-tration of Hydrogen in Furnace (%) | Primary Cooling Rate (° C./sec) | Secondary Cooling Rate (° C./sec) | Tempering Reduction Ratio (%) |
| 1 | Con1 | 1185 | 912 | 582 | 25 | 81 | 29 | 782 | 5.1 | 2.7 | 4.2 | 0.8 |
| | Con2 | 1184 | 921 | 602 | 24 | 79 | 26 | 785 | 4.5 | 2.5 | 4.3 | 0.92 |
| 2 | Con3 | 1187 | 918 | 565 | 31 | 82 | 28 | 792 | 5.2 | 3.5 | 3.3 | 0.85 |
| | con4 | 1187 | 896 | 581 | 28 | 81 | 23 | 796 | 6.1 | 3.0 | 3.7 | 0.78 |
| 3 | Con5 | 1214 | 903 | 712 | 27 | 79 | 30 | 801 | 5.8 | 4.3 | 5.1 | 1.2 |
| | Con6 | 1212 | 924 | 708 | 45 | 78 | 33 | 812 | 5.2 | 9.1 | 6.1 | 1.3 |
| 4 | Con7 | 1195 | 912 | 765 | 43 | 79 | 31 | 811 | 6.1 | 5.6 | 6.3 | 1.1 |
| | Con8 | 1196 | 921 | 602 | 35 | 78 | 34 | 806 | 3.5 | 5.2 | 8.4 | 1.45 |
| 5 | Con9 | 1224 | 914 | 612 | 32 | 65 | 18 | 802 | 3.5 | 4.5 | 11.4 | 0.3 |
| | Con10 | 1228 | 923 | 635 | 6 | 86 | 42 | 798 | 3.1 | 8.5 | 12.1 | 0.8 |
| 6 | Con11 | 1187 | 906 | 623 | 19 | 74 | 17 | 772 | 3.5 | 7.7 | 8.9 | 0.8 |
| | Con12 | 1194 | 908 | 625 | 22 | 82 | 34 | 798 | 33.1 | 12.2 | 7.2 | 0.92 |
| 7 | Con13 | 1189 | 916 | 596 | 25 | 81 | 35 | 825 | 3.6 | 4.8 | 6.5 | 1.03 |
| 8 | Con14 | 1201 | 915 | 632 | 26 | 80 | 37 | 826 | 4.4 | 3.9 | 6.5 | 1.36 |

Con1 to Con14: Condition 1 to Condition 14

Zinc-based alloying plated steel sheet specimens were prepared under conditions of Table 2 using the slabs having the compositions shown in Table 1. Physical properties of each specimen were evaluated and evaluation results are shown in Table 3 below. Tensile strength was measured by tensile test in a length direction of the specimen according to the ASTM standards. An aging index (AI) was measured as an elongation (YP-EL) at a yield point by performing a tensile test in a direction, perpendicular to a rolling direction, after thermally treating each of the specimens at a temperature of 100° C. for 60 minutes. A microstructure was examined by observing a point of 1/4*t (t referring to a thickness of a specimen) of a base steel sheet with an optical microscope with respect to a cut surface of each of the specimens. Values of R(BH) and R(AI), associated with Relational Expression 2, were obtained by observing boron (B) in units of atoms at the point of 1/4*t (t referring to a thickness of a specimen) of the base steel sheet using an atom probe tomography (APT) to measure a concentration ratio thereof.

TABLE 3

| Steel Type | Classification | Occupation Rate of Grains Having Average Diameter of 8 μm or less (%) | Relational Expression 1 $C_s$ (wt %) | Relational Expression 2 $R_B$ | AI (YP-EL) (%) | L-BH (MPa) | YS (MPa) | TS (MPa) | EL (%) | Note |
|---|---|---|---|---|---|---|---|---|---|---|
| 1 | Con1 | 76.1 | 0.0008 | 1.35 | 0 | 38 | 221 | 365 | 39 | IE1 |
| | Con2 | 79.0 | 0.0008 | 1.42 | 0 | 39 | 226 | 371 | 38 | IE2 |
| 2 | Con3 | 81.2 | 0.0009 | 1.36 | 0 | 36 | 216 | 365 | 40 | IE3 |
| | Con4 | 80.6 | 0.0009 | 1.42 | 0 | 36 | 215 | 362 | 40 | IE4 |
| 3 | Con5 | 78.5 | 0.0013 | 1.28 | 0 | 37 | 243 | 382 | 37 | IE5 |
| | Con6 | 77.5 | 0.0013 | 1.46 | 0 | 36 | 246 | 386 | 36 | IE6 |
| 4 | Con7 | 35.6 | 0.0009 | 1.03 | 0.36 | 32 | 216 | 356 | 41 | CE1 |
| | Con8 | 78.2 | 0.0009 | 1.43 | 0 | 35 | 217 | 358 | 41 | IE7 |
| 5 | Con9 | 63.5 | 0.0014 | 1.18 | 0.65 | 42 | 231 | 364 | 38 | CE2 |
| | Con10 | 61.5 | 0.0014 | 1.06 | 0.42 | 41 | 236 | 369 | 37 | CE3 |
| 6 | Con11 | 67.7 | 0.0023 | 1.22 | 0.22 | 25 | 257 | 376 | 33 | CE4 |
| | Con12 | 85.6 | 0.0023 | 1.30 | 0.39 | 38 | 221 | 368 | 37 | CES |
| 7 | Con13 | 66.3 | 0.0009 | 0.4 | 0 | 19 | 216 | 346 | 41 | CE6 |
| 8 | Con14 | 63.2 | 0.0021 | 0 | 1.23 | 26 | 221 | 359 | 37 | CE7 |

Con1 to Con14: Condition 1 to Condition 14
IE: Inventive Example / CE: Comparative Example The characteristics required in the present disclosure are basically yield strength of 210 MPa, lower-bake hardenability (L-BH) value of 30 MPa, and an aging index (AI, YP-EL) which should satisfy 0.2 or less to have aging resistance guarantee of 6 month or more at room temperature. It is confirmed that Inventive Examples satisfied all of the required characteristics but, but Comparative Examples 1 to 7 did not satisfy at least one of the required characteristics, and thus, did not satisfy one of the characteristics such as high strength, room-temperature aging resistance, and bake hardenability.

As can be seen from Tables 1 to 3, in Inventive Examples 1 to 7 satisfying the alloying composition and manufacturing conditions limited by the present disclosure, an area ratio of grains having an average grain size of 8 μm or less in a cross section of the base steel sheet was secured to be 70% or more. Also, it is confirmed that in the lower-bake hardenability (L-BH) value satisfied 30 MPa or more and the aging index (AI, YP-EL) satisfied 0.2% or less.

On the other hand, it is confirmed that since Comparative Examples 1 to 3 satisfied the alloying composition of the present disclosure but did not satisfy process conditions of the present disclosure, grains of the base steel sheet were coarsely formed and a value of $R_B$ calculated by Relational Expression 2 was less than 1.2, and thus, a target aging index was not secured. It is confirmed that since Comparative Examples 4 and 5 satisfied the alloying composition of the present disclosure but a value of $C_S$ calculated by Relational Expression 1 was greater than 0.002, the aging index (AI, YP-EL) was greater than 2.0, and thus, aging resistance characteristics were deteriorated. It is also confirmed that since a reduction ratio of an initial rolling role was less than 20%, an area ratio of grains having an average grain size of 8 μm or less in a cross section of a base steel sheet was less than 70%.

In Comparative Examples 6 and 7, it is confirmed that the content of boron (B) was less than the content of B in the present disclosure, and thus, bake hardening characteristics were deteriorated. In particular, in Comparative Example 6, it is confirmed that a value of $C_S$ calculated through Relational Expression 1 satisfies the range of the present disclosure, but the content of B was only 0.0007%, bake hardening characteristics required in the present disclosure were satisfied.

Therefore, according to an aspect of the present disclosure, a zinc-based plated steel sheet having excellent room-temperature aging resistance in which, yield strength is 210 MPa or more, an aging index (AI) for evaluating room-temperature aging resistance is 0.2 or less, and lower-bake hardening (L-BH) value for evaluating bake hardenability is 30 MPa or more, and a method for manufacturing the same are provided.

While the present disclosure has been described in detail with reference to the examples, the present disclosure may be embodied in many different forms. Accordingly, the technical idea and the scope of claims set forth below are not limited to the preferred examples.

The invention claimed is:

1. A zinc-based plated steel sheet, the zinc-based plated steel sheet comprising:

a base steel sheet and a zinc-based plated layer formed on a surface of the base steel sheet;

a yield strength of 210 MPa or more; and an elongation of 35% or more, wherein the base steel sheet comprises, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur(S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), and a balance of iron (Fe) and unavoidable impurities, and $R_B$ of Relational Expression 2 below is 1.2 or more, $$R_B = R(\mathrm{BH})/R(\mathrm{AI}), \qquad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

2. The zinc-based plated steel sheet of claim 1, wherein the base steel sheet is a cold-rolled steel sheet.

3. The zinc-based plated steel sheet of claim 1, wherein a microstructure of the base steel sheet is a ferrite single-phase structure, and wherein the ferrite single-phase structure includes grains having an average diameter of 8 μm or less, and the grains account for 70% or more of area ratio in a cross section of the base steel sheet.

4. The zinc-based plated steel sheet of claim 1, wherein a lower-bake hardening (L-BH) value of the zinc-based plated steel sheet is 30 MPa or more, and an aging index (AI) of the zinc-based plated steel sheet is 0.2% or less.

5. A zinc-based plated steel sheet, the zinc-based plated steel sheet comprising:

a base steel sheet and a zinc-based plated layer formed on a surface of the base steel sheet;

a yield strength of 210 MPa or more; and an elongation of 35% or more, wherein the base steel sheet comprises, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur(S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), and a balance of iron (Fe) and unavoidable impurities, and $C_S$ of Relational Expression 1 below satisfies a range of 0.0002% to 0.002%, and $R_B$ of Relational Expression 2 below is 1.2 or more, $$C_S = [\mathrm{C}] - (12/93) * [\mathrm{Nb}] \qquad \text{Relational Expression 1:}$$

where [C] and [Nb] of Relational Expression 1 refer to contents (wt %) of C and Nb of the base steel sheet, respectively, and $$R_B = R(\mathrm{BH})/R(\mathrm{AI}), \qquad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

6. The zinc-based plated steel sheet of claim 5, wherein the base steel sheet is a cold-rolled steel sheet.

7. The zinc-based plated steel sheet of claim 5, wherein a microstructure of the base steel sheet is a ferrite single-phase structure, and wherein the ferrite single-phase structure includes grains having an average diameter of 8 μm or less, and the grains account for 70% or more of area ratio in a cross section of the base steel sheet.

8. The zinc-based plated steel sheet of claim 5, wherein a lower-bake hardening (L-BH) value of the zinc-based plated steel sheet is 30 MPa or more, and an aging index (AI) of the zinc-based plated steel sheet is 0.2% or less.

9. A method for manufacturing a zinc-based plated steel sheet, the method comprising:

reheating a slab to a temperature within a range of 1160° C. to 1250° C., the slab comprising, by weight percentage (wt %), carbon (C): 0.005% or less (excluding 0%), manganese (Mn): 0.1 to 1.0%, silicon (Si): 0.3% or less (excluding 0%), phosphorous (P): 0.01 to 0.08%, sulfur(S): 0.01% or less, nitrogen (N): 0.01% or less, soluble aluminum (sol.Al): 0.01 to 0.06%, niobium (Nb): 0.002 to 0.02%, boron (B): 0.001 to 0.004% (excluding 0.001%), a balance of iron (Fe), and unavoidable impurities;

hot rolling the reheated slab to a temperature within a range of 850° C. to 1150° C. to provide a hot-rolled steel sheet;

cooling the hot-rolled steel sheet at an average cooling rate of 10° C./sec to 70° C./sec and coiling the cooled hot-rolled steel sheet to a temperature within a range of 500° C. to 750° C.;

cold rolling the coiled hot-rolled steel sheet at a reduction ratio of 70% to 90% to provide a cold-rolled steel sheet;

heating the cold-rolled steel sheet in a furnace atmosphere with a hydrogen concentration of 3% to 30% to a temperature within a range of 750° C. to 860° C. to be continuously annealed;

cooling the continuously annealed cold-rolled steel sheet; and providing the cold-rolled steel sheet as a base steel sheet and dipping the cold-rolled steel sheet into a hot-dip zinc-based plating bath to manufacture a zinc-based plated steel sheet, wherein the cold rolling is performed by sequential reduction using a plurality of rolling rolls and a reduction ratio of an initial rolling roll, among the plurality of rolling rolls, is 20% to 40%, in the base steel, $C_S$ of Relational Expression 1 below satisfies a range of 0.0002% to 0.002%, and $R_B$ of Relational Expression 2 below is 1.2 or more, $$C_S=[C]-(12/93)*[Nb] \quad \text{Relational Expression 1:}$$

where [C] and [Nb] of Relational Expression 1 refer to contents (wt %) of C and Nb of the base steel sheet, respectively, and $$R_B=R(BH)/R(AI), \quad \text{Relational Expression 2:}$$

where R(BH) of Relational Expression 2 denotes a concentration ratio of boron (B) present within 20 nm of a ferrite grain boundary in the base steel sheet in a grain direction during a heat treatment performed on the zinc-based plated steel sheet at a temperature of 170° C. for 20 minutes, and R(AI) of Relational Expression 2 denotes a concentration ratio of boron (B) present within 20 nm of a ferrite grain boundary in the base steel sheet in the grain direction during a heat treatment performed on the zinc-based plated steel sheet at a temperature of 100° C. for 60 minutes.

10. The method of claim 9, wherein the annealed cold-rolled steel sheet is primarily cooled to a temperature within a range of 630° C. to 670° C. at an average cooling rate of 2° C./sec to 10° C./sec, and the primarily cooled cold-rolled steel sheet is secondarily cooled to a temperature within a range of 440° C. to 480° C. at an average cooling rate of 3° C./sec to 20° C./sec.

11. The method of claim 9, wherein the cold-rolled steel sheet is dipped in a hot-dip zinc-based plating bath of 440° C. to 480° C.

12. The method of claim 9, wherein the zinc-based plated steel sheet is temper-rolled at a reduction ratio of 0.3% to 1.6%.

* * * * *